350-6.91 SR

XR 4,045,803

16.91

United Stat

Baylis et al.

[11] 4,045,803

[45] Aug. 30, 1977

[54] PHOTOCOMPOSING APPARATUS

[75] Inventors: Howard Raymond Baylis, East Grinstead; Roger Alan Edwards, Crawley Down, both of England

[73] Assignee: The Monotype Corporation Limited, Salfords, England

[21] Appl. No.: 600,960

[22] Filed: Aug. 1, 1975

[30] Foreign Application Priority Data

Aug. 6, 1974 United Kingdom ..... 34656/74

[51] Int. Cl.[2] ..... B41B 13/00

[52] U.S. Cl. ..... 354/5; 350/6

[58] Field of Search ..... 354/5, 10, 17, 8, 9, 354/13, 14; 350/6, 7; 355/52

[56] References Cited

U.S. PATENT DOCUMENTS 3,687,025 8/1972 Rosin ..... 354/5

3,733,979 5/1973 England ..... 350/6 UX 3,881,801 5/1975 Bechtold ..... 350/6

*Primary Examiner*—John Gonzales

*Attorney, Agent, or Firm*—Morgan, Finnegan, Pine, Foley & Lee

[57] ABSTRACT

Photocomposing apparatus comprising a projection system for projecting optical images selected from a character matrix onto a photosensitive recording member by way of a mirror which is rotatable to displace projected images with respect to the recording member. The projection system includes a wide-angle lens for focussing the optical images onto a substantially flat image plane coincident with the recording member, and a zoom lens system arranged to produce a first fixed image which provides, by the action of the rotatable mirror, an object for the wide-angle lens which is selectively positionable in a substantially flat object plane.

9 Claims, 8 Drawing Figures

PHOTOCOMPOSING APPARATUS

This invention relates to photocomposing apparatus for projecting selectable character images onto a photosensitive recording member.

It is common to provide, in such apparatus, an optical projecting system for projecting optical images formed by illuminating selected characters on an adjustable character matrix, or font, to successive positions in an image line at the position of the recording member. The recording member is usually a roll of photosensitive film which is made to move intermittently past the image line, between the exposure of the film to successive rows of characters.

The placement of characters at successive positions along the image line in the process of photocomposition often involves the use of slow, heavy and precise mechanism.

Alternatively, a rotatable mirror may be used to reflect a beam in a swinging arc onto the surface of a film, but here the image plane is arcuate, having a centre of curvature on the axis of rotation of the mirror, and the image-receiving portion of the film must consequently be maintained with the correct curvature to prevent distortion at the edges of the film. This can be especially inconvenient when the image arc is across the width of a roll of sensitized film as is the usual practice, as mentioned above.

Optical flatteners have been developed such as the fibre optic faceplate which is the subject of our copending U.S. Patent application Ser. No. 400826. This device is a plate made from optic fibres, and has a curved surface onto which character images are projected, and a plane surface against which the film is held. The fibres are arranged to counteract focal distortion and preferably also spacial distortion. These are, however, expensive to make and call for high precision in the arrangement of the optic fibres to ensure accurate positioning of the character image on the flat output face of the fibre optic plate.

The object of the present invention is to use standard optical elements to achieve a substantially flat image field.

According to the invention, there is provided photocomposing apparatus comprising a projection system for projecting optical images selected from a character matrix onto a photosensitive recording member by way of a mirror which is rotatable to displace projected images with respect to the recording member, and including a wide-angle lens for focussing the optical images onto a substantially flat image plane coincident with the recording member, means being provided for producing a first fixed image which provides, by the action of said rotatable mirror, an object for the wide angle lens which is selectively positionable in a substantially flat object plane.

By wide angle lens is meant one which will accept rays of light diverging considerably from its axis, so that an image may be formed where a normal lens would not have an acceptance angle large enough to form an image.

Means for rotating the rotatable mirror preferably comprise a stepwise operable motor, by which, after each exposure of the film to a selected character, the mirror is rotated by a fine, adjustable step, so as to project the next succeeding character to a position on the film adjacent the previous character. The size of the steps may be adjusted so as to alter the spacing of the characters.

The projection system may include a zoom lens system by which the selected illuminated characters are focussed to produce the first fixed image at a position on or near to the optical axis of the wide angle lens, and so that, in its mean central position, the mirror is perpendicular to the beam incident thereon as measured in a plane normal to the axis of rotation of the rotatable mirror. In this arrangement, in order that the zoom lens system may be disposed so as to avoid obstruction of the wide-angle lens, the first fixed image may be positioned by means of a mirror fixed obliquely to the optical axis of the zoom lens and tilted relative to the rotatable mirror so that the beam reflected by the rotatable mirror into the wide-angle lens is not obstructed by the fixed mirror.

Alternatively, the rotatable mirror may be arranged so that in its central mean position, that is its position when a character is being projected to the middle of a character line, it is not perpendicular to the beam from the first fixed image as measured in a plane normal to the axis of rotation of the mirror. A fixed mirror for separating the zoom lens and the wide-angle lens systems is then unnecessary. The rotatable mirror may be arranged to reflect light from the first fixed image into the lens, such that rotation of the mirror causes movement of a second, movable, virtual image produced by the rotatable mirror, in a substantially flat object plane transverse to the axis of the lens. The wide-angle lens thereby produces images in a flat image plane coincident with the surface of the film.

The axis of rotation of the mirror may be at the mirror, or may be in front of the mirror. In the latter case, as will be explained hereinafter, an improvement in the overall flatness of the plane of the movable virtual image may be achieved.

Adjustment of the zoom lens system alters the size of the images projected onto the film.

Some embodiments of the invention will now be described by way of example with reference to the accompanying drawings, in which.

Figures 1, 2:
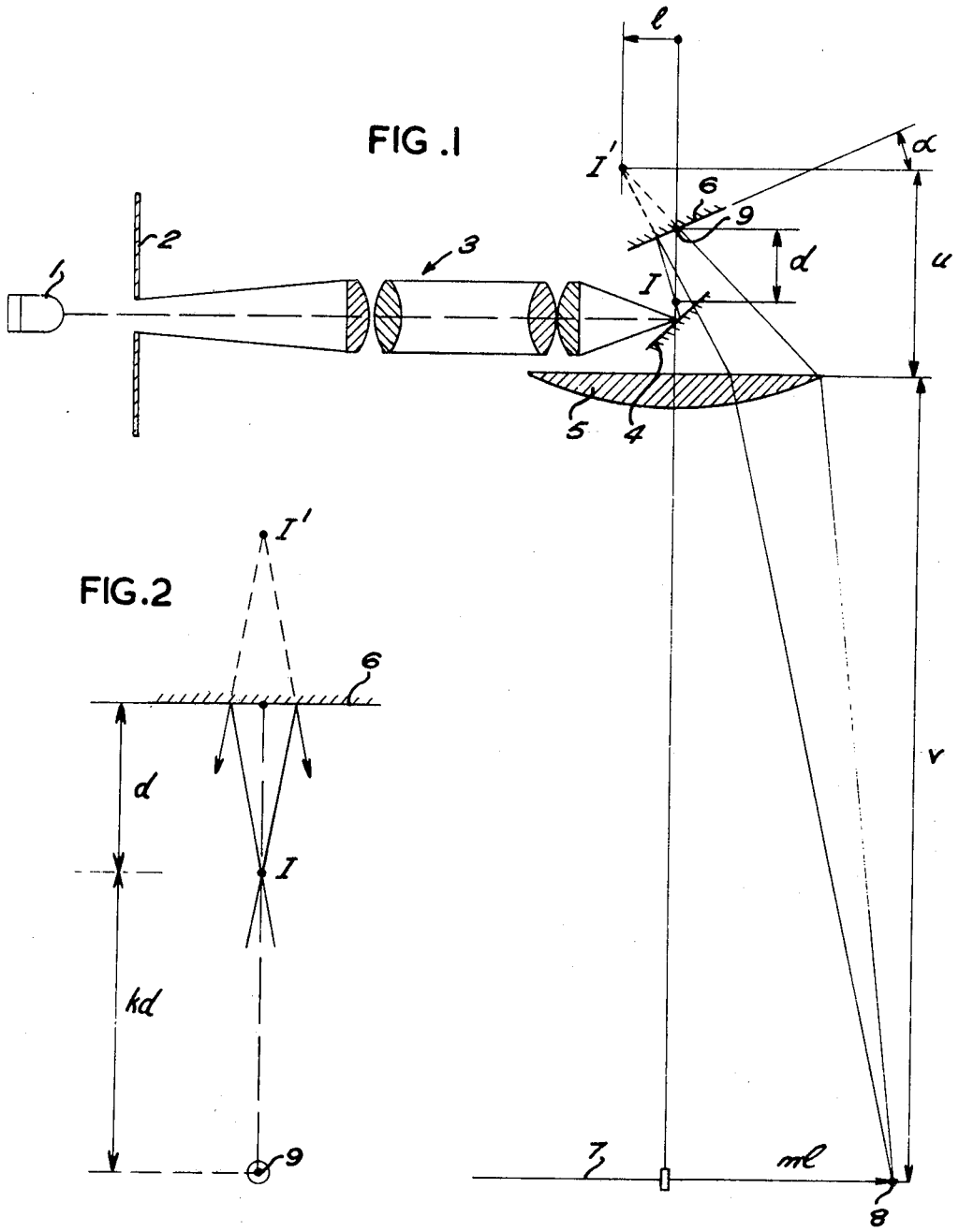
FIG. 1 is a plan view of the optical system of a photocomposing apparatus in accordance with the invention.
FIG. 2 illustrates a modification of the system illustrated in FIG. 1.
Figure 3A:
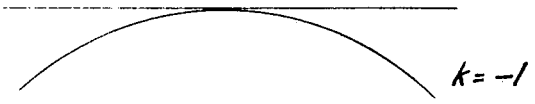
Figure 3B:
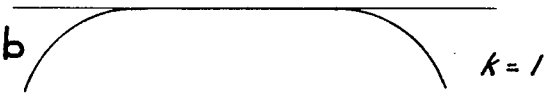
Figure 3C:
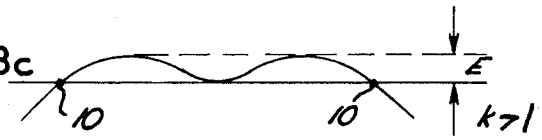
Figure 4:
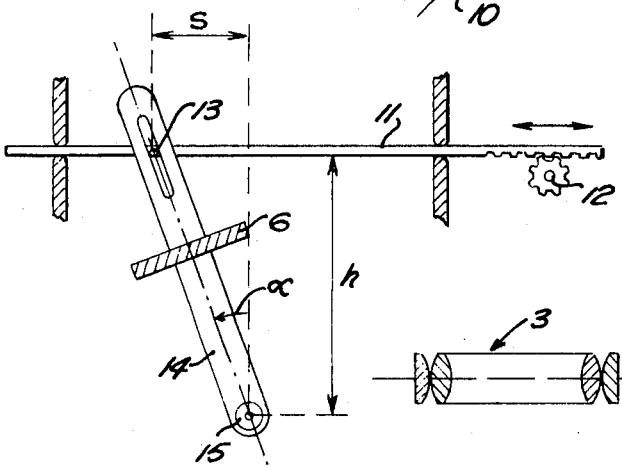
Figure 5:
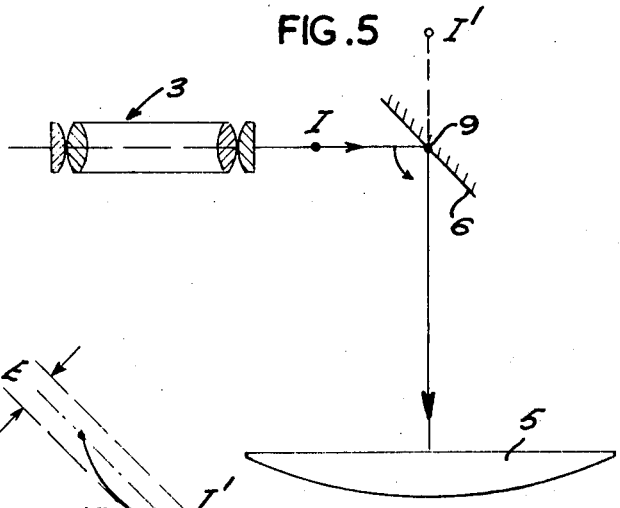
Figure 6:
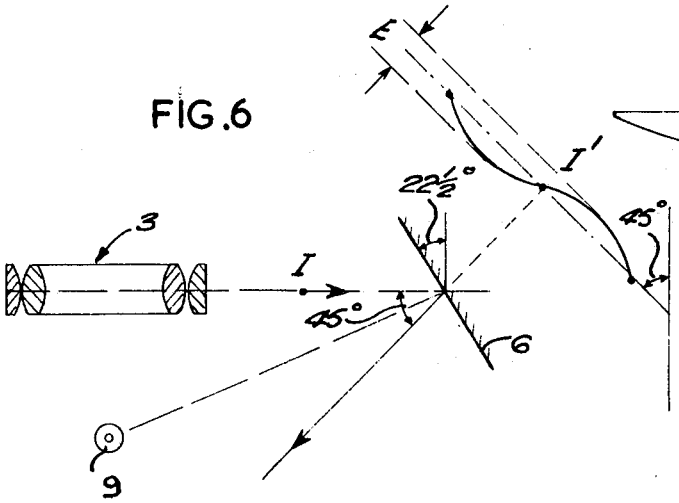

FIGS. 3*a* to 3*c* illustrate the shape of an image plane obtained in the systems of FIGS. 1 and 2;

FIG. 4 illustrates a mechanical system for controlling the rotatable mirror of the optical systems of FIGS. 1 and 2;

FIG. 5 illustrates a further modification of the system illustrated in FIG. 1; and FIG. 6 illustrates a modification of the system illustrated by FIG. 5, and the shape of an image plane obtained thereby.

With reference first to FIG. 1, a light source 1 illuminates a selected character in a fixed size array of characters 2 in a font array, or character matrix by any known method. A zoom lens system 3 creates an image I of the character at a suitable size of the line of type being composed. A mirror 4 arranged at an oblique angle to the axis of the zoom lens system, places the image I on the axis of a wide-angle lens 5 so that the light travels away from the lens.

A mirror 6 is mounted on a rotating member such as a stepping motor (not shown) and is shown rotated by an angle $\alpha$ from the normal to the axis of lens 5.

A virtual image of the character image I is created behind the mirror 6 at $I^1$, such that its displacement 1 from the axis of lens 5 is a function of the separation *d* of image I from the mirror and the angle $\alpha$ of orientation of the mirror.

The mirrors 4 and 6 are relatively tilted with reference to a normal to the plane of the figure so that light from the virtual image $I^1$ passes over the top of mirror 4 and into the lens 5 at an angle dependent on the degree of tilt of mirror 6 to form a real image 8 at the plane of a surface of a light sensitive element 7. This particular tilt is a permanent minor adjustment having no effect on the following discussion concerning the geometry of the optical arrangement in two dimensions only, that is, in the plane of the drawings. If the object and image distances from the lens are respectively U and V then the magnification $m = V/U$ and the displacement of the image 8 will be $m \times 1$.

When a character is projected to the middle region of a character line on the element 7, that is, when $m = 1$ is approximately zero, the mirror 6 is approximately perpendicular to the incident and reflection light beams, that is, the angles of incidence and reflection, as measured in the plane of the drawing, that is, in a plane normal to the axis of rotation of the mirror 6 are approximately zero.

It should be noted that where the mirror 6 pivots about an axis 9 on its face, this object distance U remains almost constant for a small angle of swing. Thus, for limited angle of mirror swing, the combination of the mirror 4 and mirror 6 places the movable image $I^1$ in a substantially flat field, thereby producing a substantially flat object field for the lens 5.

Now, the property of a wide angle lens is to produce a nominally flat field even under heterochromatic light conditions. When the light source is monochromatic (such as laser light) then the lens may produce a substantially flatter field.

In the above-described embodiment, in which the axis of rotation 9 is at the mirror, and substantially (taking into account the aforementioned relative tilt between mirrors 4 and 6) in the plane thereof the focus of the virtual image $I^1$ is a circle of radius *d.* As mentioned above, the angle of turn of the mirror is necessarily relatively small in order to maintain the plane of image $I^1$ as flat as possible.

An improvement is achieved by moving the axis of rotation in front of the mirror. This arrangement is illustrated generally in FIG. 2, in which the distance from the rotational axis to the mirror is $(1+k)d$. It can be shown that as the axis 9 begins to move away from the mirror, the image field becomes flatter. FIGS. 3*a* to 3*c* show the shape of image field obtained when $k=-1$, that is when axis 9 is in the plane of the mirror, when $k=1$, and when $k$ is greater than 1. When $k=1$ the image field is approximately flat near the centre, that is when the mirror is near its central mean orientation, but is displaced towards the mirror for larger angles of mirror swing, as shown in FIG. 3*b.* When $k$ increases above 1, the image $I^1$ displaces from its central position, in a sense away from the mirror as the mirror tilts away from its central mean position, but as the mirror swings further the displacement decreases, and drops to zero at points 10. Further tilting of the mirror displaces the image towards the mirror, as shown in FIG. 3*c.*

It can be shown that the overall deviation from a flat image field, for a given maximum mirror tilt is least when shaped as in FIG. 3*c,* with the two points 10 corresponding to the extreme positions of image $I^1$ for the maximum mirror tilt in either sense from its central mean position. It can also be shown that these points occur where $k = 1/\text{Cos}\alpha = \text{Sec}\alpha$. Thus, by setting $\alpha$ at the required maximum value, an appropriate value for $k$ can be derived.

Further, it can be shown that the ratio of maximum image deviation E (see FIG. 3*c*) to the line length, i.e. the distance between the two points 10 in FIG. 3*c* is $(1-\text{Cos}\alpha^1)^2/8\text{Sin}\alpha^1$, where $\alpha^1$ is the maximum mirror tilt. When, for example, $\alpha^1=10°$ (that is the total angle of mirror tilt is from $-10°$ to $+10° = 20°$. The reflected beam thus rotates through 40°) this ratio is 0.000166, with $k$ set at 1.01543, and for a line length of 2 inches, (which, for example, will be magnified five times by the lens 5 to give a 10 inch line on the element 7) the maximum image deviation E=0.000332 inch. The wide angle lens system will generally have a depth of field which will be greater than this, so that the images 8 will be in sharp focus in the plane of element 7.

A further improvement over the above-described embodiment and modifications thereof, is to avoid the necessity of providing the mirror 4, which serves to separate the zoom lens system and the wide-angle lens, but which necessitates the aforementioned tilting of the mirror 6 to project the beam reflected therefrom over the mirror 4, causing distortion of the character shape and placement. This is achieved, as shown in FIG. 5, by disposing the mirror 6 to be oblique to the beam from image I in its central mean position when the axis of rotation 9 is in the plane of the mirror, as in FIG. 5, the image $I^1$ lies in an arcuate image field as in the arrangement of FIG. 1. However, a flatter image field may be produced by a suitable choice of the axis of rotation in front of the mirror. Generally, the smaller the value of $\phi$, the angle between the incident beam and the reflected beam in the central mean position of the mirror, the easier it is to achieve a relatively flat image field. Thus, $\phi$ is set as small as possible, while ensuring that the zoom lens and wide angle lens systems do not obstruct one another. FIG. 6 shows an arrangement where $\phi=45°$, and the rotational axis is positioned so that for three mirror positions ($12\frac{1}{2}°$, $22\frac{1}{2}°$ and $32\frac{1}{2}°$ to the vertical as shown in FIG. 5) the image $I^1$ is in a plane at 45° to the vertical. This represents a total mirror swing of 20°, as before. The maximum deviation E, for a line length of 2 inches is 0.010 inch. Thus while this arrangement avoids using a second mirror, the depth of field required of the wide angle lens system, though readily obtainable in practice is greater than in the embodiment of FIG. 1.

It is clear that if, in the embodiments of FIGS. 1 to 3, the stepping motor is operated such that the mirror 6 rotates through angles of displacement which do not vary as the separation 1 of the image $I^1$ from the axis of lens 5 varies, the spacing of the characters is greater at the edges of the film 7 than in the centre zone, since the value of 1 is proportional to tan $\alpha$. The displacement and the final image displacement ml may thus be made to change by equal steps only when the stepping motor operates in accordance with a tangent function. This may be achieved by applying a correction as the displacement 1 increases, when operating the motor in stepwise fashion in accord with our British Pat. No. 1,178,834. A computer used in the type setting process may be programmed to make decreasing angular increments of the mirror as the displacement 1 increases.

Alternatively, a mechanical system illustrated in FIG. 4 may be employed. A linearly movable rack 11, has a toothed end portion which engages a rotatable pinion 12 coupled to a stepping motor whose spindle rotates in a succession of equal incremental steps. The rack 11 is thus displaced longitudinally in corresponding equal linear steps. A pin 13 attached to the rack slides in an elongate slot in a mirror lever 14 which is arranged to rotate about an axis 15 remote from the slot. The mirror 6 is mounted on the lever 14 normal to the longitudinal axis thereof at the appropriate point in accordance with the selected value for $k$. If $h$ is the perpendicular distance from the axis 15 to the lever 14, $s$ is the variable distance between the pin 13 and the line normal to the lever 14 and passage through the axis 15, and $\alpha$ is the angle of tilt of the mirror about axis 15, then $\tan \alpha = s/h$, and thus $\tan \alpha$ is proportional to $s$. The displacement 1 of image $I^1$ is proportional to $\tan \alpha$, and so 1 is proportional to $s$; that is to say when this mechanical arrangement is employed to rotate the mirror 6, displacement of the image I and of image 8, is proportional to the displacement of the rack 11, and the uniform rotational stepping of the pinion 12 will produce uniform linear displacements in the final character image position.

In the case of the embodiments illustrated by FIG. 5, the functional relationship between the mirror rotation and the character displacement will not, in the general case be a simple tangential one, and would have to be evaluated for each particular arrangement, and stored, preferably by a computer.

It is clear that the virtual image $I^1$ is not normal to the axis of the lens for all displacements $\alpha$ of the mirror, but rather is inclined to the normal thereto at an angle of $2\alpha$. If the real width of the character is W, then its apparent width will be $W\cos 2\alpha$, and the twist relative to the normal to the lens axis will necessitate and additional depth of field of the wide angle lens of $W\sin 2\alpha$. However, in practice, the image is of small finite size and any blurring at the edges of the character and variation in the character sizes along the character line is of no great significance.

The systems described in accordance with the invention produce a substantially flat final image field, whilst employing standard optical elements.

We claim:

1. Photocomposing apparatus comprising a projection system for projecting optical images of characters selected from a matrix of master characters onto a photosensitive recording member, wherein the projection system includes: a mirror which is rotatable to displace projected optical images with respect to the recording member; a wide angle lens for focussing the projected optical images onto a substantially flat image recording plane coincident with the recording member; means for illuminating the character matrix and producing a light beam bearing images of the selected characters; and means for focussing said light beam to produce a first fixed image of the selected characters which provides, by the action of said rotatable mirror, a second image forming an object for the wide-angle lens which is selectively positionable in a substantially flat object plane.

2. Photocomposing apparatus according to claim 1 wherein the rotatable mirror is arranged to rotate about a mean position in which a fixed beam from the first fixed image is incident thereon at an angle of incidence of substantially zero as measured in a plane normal to the axis of rotation of the rotatable mirror.

3. Photocomposing apparatus according to claim 2 wherein the projection system is so arranged that the fixed beam incident on the rotatable mirror is substantially parallel to the axis of the wide-angle lens, and wherein in said mean position, the rotatable mirror extends substantially normally to said axis of the wide-angle lens.

4. Photocomposing apparatus according to claim 3 including a further mirror fixed obliquely to the axis of the wide-angle lens for directing said fixed beam toward said rotatable mirror.

5. Photocomposing apparatus according to claim 3 wherein said first fixed image is formed on the axis of the wide-angle lens.

6. Photocomposing apparatus according to claim 1 wherein the rotatable mirror is arranged to rotate about a mean position in which a fixed beam from the first fixed image is incident thereon at a non-zero angle of incidence as measured in a plane normal to the axis of rotation of the rotatable mirror.

7. Photocomposing apparatus according to claim 6 wherein the wide-angle lens is arranged so that in said mean position of the rotatable mirror, a beam is reflected therefrom, toward said wide-angle lens axially thereof.

8. Photocomposing apparatus according to claim 1 wherein the axis of rotation of the rotatable mirror lies substantially in the plane of said mirror.

9. Photocomposing apparatus according to claim 1, wherein the axis of rotation of the mirror is in front of said mirror.

* * * * *